US009297604B1

(12) United States Patent
Sidebottom et al.

(10) Patent No.: US 9,297,604 B1
(45) Date of Patent: Mar. 29, 2016

(54) CROSSBOW CAM SYSTEM

(71) Applicant: Bear Archery, Inc., Evansville, IN (US)

(72) Inventors: Josh Sidebottom, Chandler, IN (US); Timothy Langley, Newburgh, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 14/640,771

(22) Filed: Mar. 6, 2015

Related U.S. Application Data

(60) Provisional application No. 61/974,055, filed on Apr. 2, 2014.

(51) Int. Cl.
*F41B 5/12* (2006.01)
*F41B 5/10* (2006.01)
*F41B 5/14* (2006.01)

(52) U.S. Cl.
CPC ..... *F41B 5/123* (2013.01); *F41B 5/105* (2013.01); *F41B 5/12* (2013.01); *F41B 5/1403* (2013.01)

(58) Field of Classification Search
CPC ..... F41B 5/10; F41B 5/105; F41B 5/12; F41B 5/123
USPC ..... 124/25, 25.6, 900
See application file for complete search history.

(56) References Cited

U.S. PATENT DOCUMENTS 3,809,048 A * 5/1974 Handford ..... F41B 5/123 124/25
3,854,467 A * 12/1974 Hofmeister ..... F41B 5/105 124/25.6
3,967,609 A * 7/1976 Frydenlund ..... F41B 5/105 124/25.6
3,987,777 A * 10/1976 Darlington ..... F41B 5/105 124/25.6
4,077,385 A * 3/1978 Fredrickson ..... F41B 5/10 124/25.6
4,169,456 A * 10/1979 Van House ..... F41B 5/12 124/25
4,461,267 A * 7/1984 Simonds ..... F41B 5/10 124/25.6
4,649,891 A * 3/1987 Bozek ..... F41B 5/123 124/25
4,662,344 A * 5/1987 Mitchell ..... F41B 3/02 124/22
4,722,317 A * 2/1988 Hartwig ..... F41B 5/10 124/25.6
4,766,874 A * 8/1988 Nishioka ..... F41B 5/12 124/25
4,879,987 A * 11/1989 Nishioka ..... F41B 5/123 124/25
4,917,071 A * 4/1990 Bozek ..... F41B 5/12 124/24.1
4,971,020 A * 11/1990 Soderstrom ..... F41B 5/10 124/23.14
5,054,463 A * 10/1991 Colley ..... F41B 5/10 124/25.6
5,630,405 A * 5/1997 Nizov ..... F41B 5/123 124/25
5,678,528 A * 10/1997 Hadley ..... F41B 5/12 124/24.1
6,722,354 B1 * 4/2004 Land ..... F41B 5/10 124/25.6
6,776,148 B1 * 8/2004 Islas ..... F41B 5/10 124/25.6
6,792,931 B1 * 9/2004 Schaar ..... F41B 5/10 124/25.6
6,966,312 B1 11/2005 Larson
7,047,958 B1 * 5/2006 Colley ..... F41B 5/105 124/25.6

(Continued)

*Primary Examiner* — Alexander Niconovich
(74) *Attorney, Agent, or Firm* — Woodard, Emhardt, Moriarty, McNett & Henry LLP

(57) ABSTRACT

Certain embodiments of the present disclosure describe a crossbow that includes a stock assembly. Flexible limbs extend laterally from the stock assembly. Cams are rigidly attached directly to the stock assembly or to extensions from the stock assembly, typically within an area defined by the limbs.

20 Claims, 10 Drawing Sheets

(56) References Cited

U.S. PATENT DOCUMENTS

| | | | | |
|---|---|---|---|---|
| 7,204,242 | B2 * | 4/2007 | Dziekan | F41B 5/12 124/25 |
| 7,328,693 | B2 | 2/2008 | Kempf | |
| 7,363,921 | B2 | 4/2008 | Kempf | |
| 7,578,289 | B2 * | 8/2009 | Norkus | F41B 5/0094 124/25 |
| 7,637,256 | B2 * | 12/2009 | Lee | F41B 5/105 124/25.6 |
| 7,743,760 | B2 * | 6/2010 | Woodland | F41B 5/0094 124/25 |
| 7,823,572 | B2 * | 11/2010 | Anderson | F41B 5/123 124/25 |
| 7,836,871 | B2 * | 11/2010 | Kempf | F41B 5/123 124/25 |
| 7,891,348 | B2 * | 2/2011 | Colley | F41B 5/105 124/25 |
| 7,938,108 | B2 * | 5/2011 | Popov | F41B 5/123 124/25 |
| 8,387,603 | B2 * | 3/2013 | Darlington | F41B 5/10 124/23.1 |
| 8,387,604 | B1 * | 3/2013 | Terzo | F41B 5/10 124/23.1 |
| 8,522,762 | B2 * | 9/2013 | Trpkovski | F41B 5/0094 124/23.1 |
| 8,567,376 | B2 * | 10/2013 | Flint | F41B 5/12 124/20.3 |
| 8,578,918 | B1 * | 11/2013 | Islas | F41B 5/123 124/25 |
| 8,919,332 | B2 * | 12/2014 | Trpkovski | F41B 5/0094 124/23.1 |
| 8,997,728 | B2 * | 4/2015 | Popov | F41B 5/0094 124/25.6 |
| 2011/0041820 | A1 * | 2/2011 | Stanziale | F41B 5/105 124/25 |
| 2012/0125302 | A1 * | 5/2012 | Stanziale | F41B 5/123 124/25 |
| 2014/0360480 | A1 | 12/2014 | Koch | |

* cited by examiner

CROSSBOW CAM SYSTEM

CROSS-REFERENCE TO RELATED APPLICATIONS

This application claims the benefit of U.S. Provisional Application No. 61/974,055 filed Apr. 2, 2014, which is hereby incorporated by reference in its entirety.

FIELD OF THE INVENTION

The present invention relates generally to crossbows.

BACKGROUND OF THE INVENTION

Crossbows have been used for centuries for both hunting and recreation. They are characterized by horizontal limbs mounted on a stock with a bowstring that is drawn to store energy that is transferred to a bolt upon firing. On conventional compound crossbows, the bowstring is wrapped around rotatable wheels or cams that are mounted on the limbs. Aspects of the present disclosure address a different type of crossbow arrangement.

SUMMARY OF THE INVENTION

In certain embodiments a crossbow assembly is illustrated with a stock assembly, a pair of flexible limbs extending laterally from said stock assembly to limb tips, and cams rotatably mounted to respective fixed points on said stock assembly. A bowstring extends between the cams. Pulleys are mounted adjacent to the tip of each of the flexible limbs. An alternate aspect is that the cams are mounted via axles to the stock assembly, and the axle-to-axle distance between the cams remains fixed as the bowstring is drawn.

In an alternate embodiment, a crossbow assembly is illustrated with a stock assembly and a pair of cams rotatably mounted via axles to respective fixed points on the stock assembly. A bowstring extends between the pair of cams. When the bowstring of the crossbow assembly is undrawn, the bowstring is positioned forward of the cams. When the bowstring is drawn, the axle-to-axle distance between the cams remains fixed.

In some embodiments, the crossbow assembly is illustrated with the bowstring positioned forward of the cams when the bowstring is undrawn. In some embodiments, the bowstring defines disengagement points with the cams when the bowstring is drawn and held at a nock point. The distance from the nock point to the disengagement points has a forward component distance, and the disengagement points are separated by a lateral distance. The forward component distance compared to the lateral distance creates a high draw to lateral spacing ratio. Also, when drawn, the bowstring forms a narrow interior angle between the first and second disengagement points with a vertex at the nock point.

Additional objects and advantages of the described embodiments are apparent from the discussions and drawings herein.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates.

On a broad level, a crossbow system is illustrated with a stock assembly. Flexible limbs extend from the stock assembly. In one embodiment, the limbs extend forward, in the direction of shooting, and include pulleys for the power cable arrangement at their ends. The cams of the crossbow system are attached in fixed locations directly to the stock assembly or to extensions from the stock assembly. Because the cams are attached to the rigid stock assembly, their axle-to-axle distance does not change as the bow is drawn. The cams are typically located within an area defined by the limbs, providing a narrower axle-to-axle distance than if the cams were located on the limb tips. This narrower distance creates a narrower "V" shape when the bowstring is pulled into a fully drawn position, generating a larger forward force vector for firing a bolt when compared to a bow with cams located on its limbs.

Figure 1:
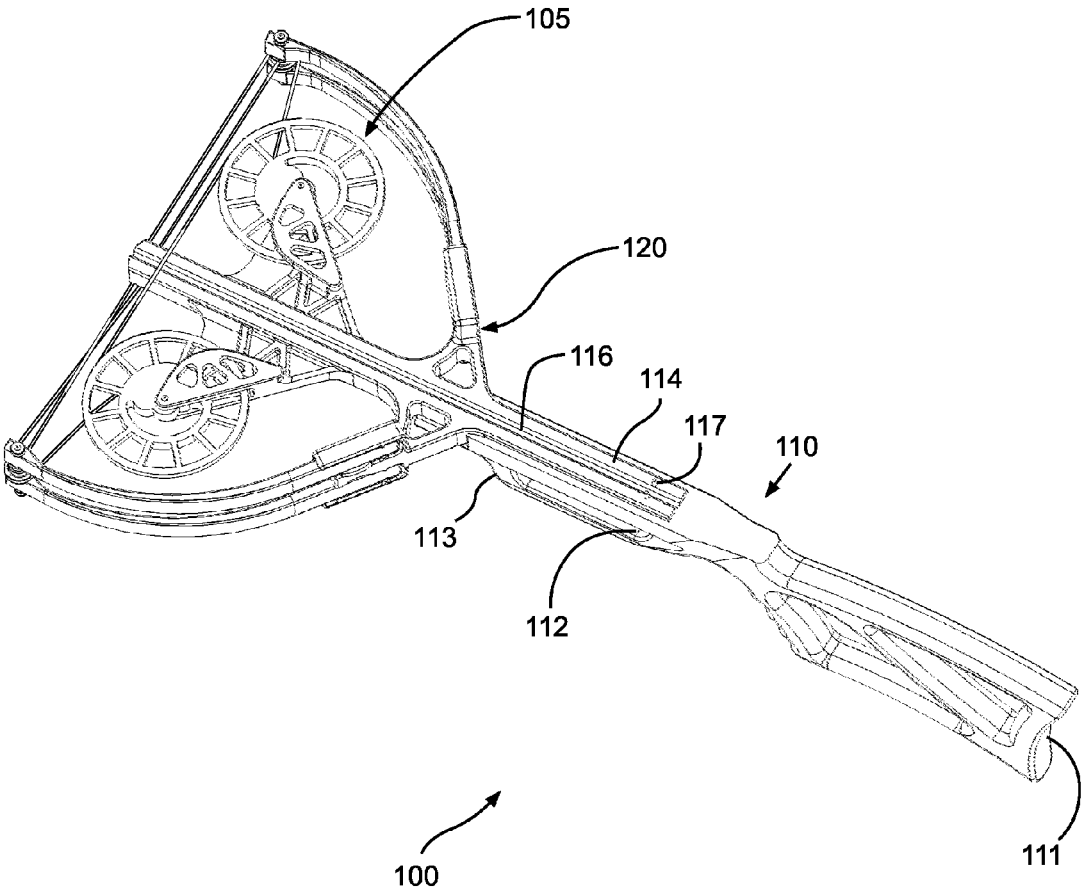
FIG. 1 is a perspective view of a crossbow system in an undrawn position for an embodiment of the present disclosure.
Figure 2:
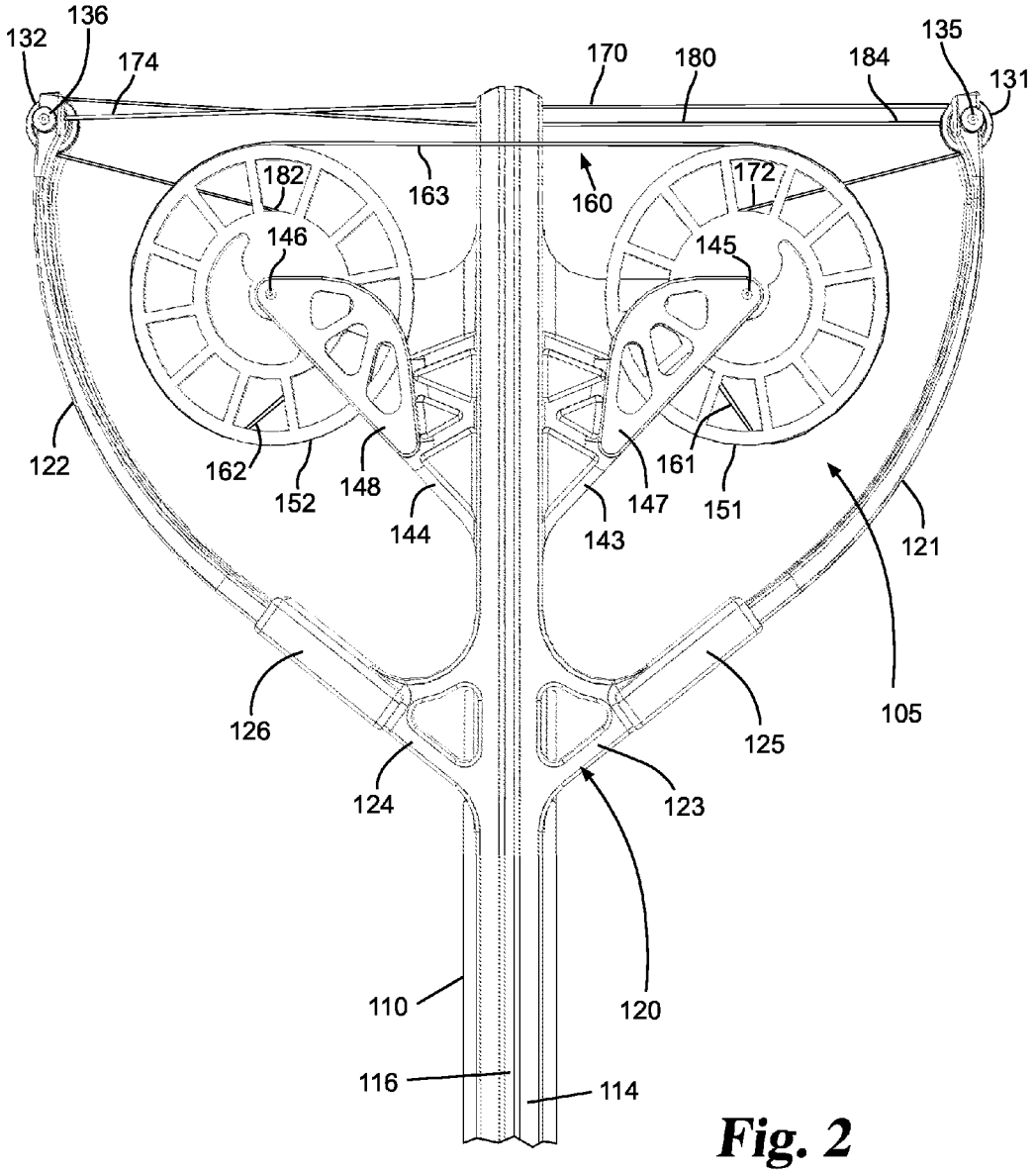
FIG. 2 is a top view of the crossbow system of FIG. 1.
Figure 3:
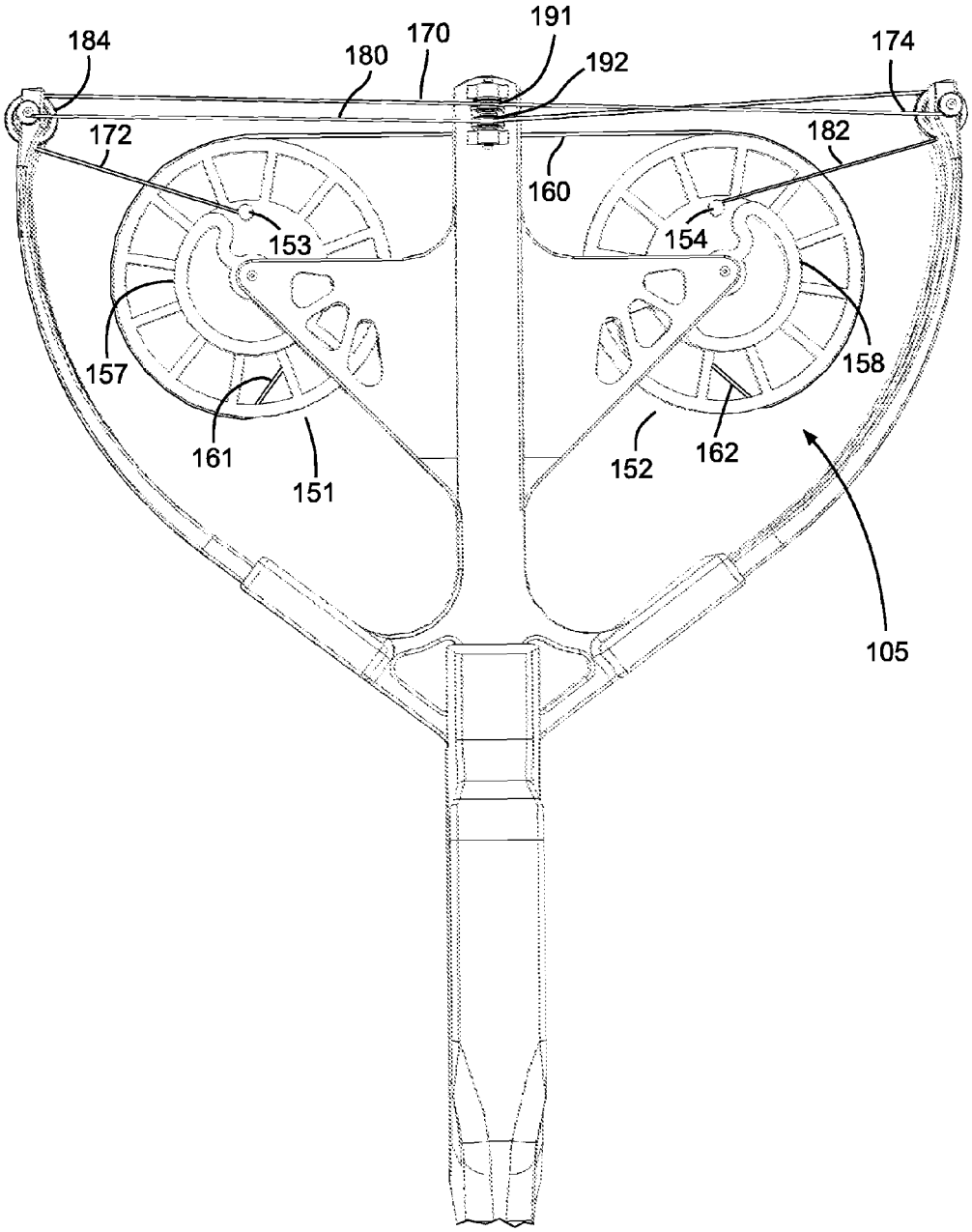
FIG. 3 is a bottom view of the crossbow system of FIG. 1.

FIGS. 1-3 illustrate an example of a crossbow system 100 shown in perspective, top, and bottom views. The crossbow system 100 includes a crossbow cam system 105, a stock assembly 110 and a riser assembly 120.

The stock assembly 110 generally includes a butt end 111, a trigger mechanism 112, a stock piece 113, and a rail 114. For the purposes of this disclosure, the forward direction of the crossbow system 100 is defined as being in the direction of shooting. The rearward direction is defined as being toward the butt end 111 of the crossbow.

The butt end 111 is at the rearward end of stock assembly 110 and forms the rearward end of the crossbow system 100. The trigger mechanism 112 is housed within the stock piece 113 and is used to fire a bolt from the crossbow. There are a variety of trigger mechanisms that are available, and any suitable mechanism for firing a bolt from the crossbow system 100 may be chosen for this embodiment.

The stock piece 113 typically provides the user with a place to hold the crossbow system 100. In the embodiment shown, rail 114 is attached to the top of stock piece 113 and extends forward past the forward edge of stock piece 113. In other embodiments, stock piece 113 may extend along the length of the entire rail 114 or stock piece 113 and rail 114 may be formed as a single piece.

Rail 114 includes a groove 116 and a launch nock point 117. Groove 116 is located on the top side of rail 114 and serves as a holding area for a bolt when the crossbow is drawn but has not yet been fired. Groove 116 also guides the bolt once it has been fired to increase accuracy. Launch nock point 117 is located near the rearward end of rail 114, close to trigger mechanism 112. When the bowstring 160 is drawn, it is pulled to the location of launch nock point 117, typically within a trigger mechanism, where it is held until trigger mechanism 112 is operated to fire the bolt. For this embodiment, the style of launch nock point 117 shown is merely representative. In other embodiments, any of the numerous varieties of launch nock points 117 and trigger mechanisms 112 available in the industry may be used.

As seen in FIG. 2, flexible limbs 121, 122 extend laterally from stock assembly 110, connecting to stock assembly 110 at riser assembly 120. Riser assembly 120 includes limb extensions 123, 124 and limb pockets 125, 126. In the embodiment shown, limbs 121, 122 have butt ends received in limb pockets 125, 126 connected to rigid limb extensions 123, 124 which extend laterally from the stock assembly 110. As illustrated, limb extensions 123, 124 extend from rail 114. The limbs 121, 122 extend laterally, away from rail 114, so that respective limb tips are arranged in the forward direction. In the embodiment shown, the limbs 121, 122 are each formed in a split limb configuration where each of lateral limbs 121, 122 is made using an upper and a lower limb piece with a gap between the pieces. In other embodiments, each limb may be made from a single piece.

An idler pulley 131, 132 is attached near the end of each limb 121, 122. Pulley 131 can be situated in the gap between the segments of the split limb 121 and secured to the limb at pulley axle 135 so that it may rotate but does not translate with respect to limb 121. Pulley 132 is symmetrically secured to the opposite limb 122 at pulley axle 136 so that it may rotate but does not translate with respect to the limb 122.

In other embodiments, the limbs are not limited to pointing in the forward direction. For example, instead of pointing forward the limbs may extend from the stock assembly 110 laterally and rearward to the limb tips with corresponding modifications to the system. For example, idler pulleys 131, 132 are then rearward of limb extensions 123, 124. In these embodiments, limb extensions 123, 124 are located at the forward end of rail 114 and limbs 121, 122 are attached to rail 114 at limb extensions 123, 124.

Cams 151, 152 are mounted to stock assembly 110, for example via cam extensions 143, 144. In certain embodiments, cam extensions 143, 144 extend from rail 114, forward of limb extensions 123, 124, and extend laterally to either side. In the embodiment shown in FIG. 2, the cam extensions 143, 144 are shaped as two roughly triangular pieces extending from rail 114. In other embodiments, cam extensions 143, 144 may be any shape that allows attachment of the cams 151, 152. Cam extensions 143, 144 are made of a rigid structure and do not move with respect to rail 114 when the crossbow is operated.

Cams 151, 152 are attached to each side of stock assembly 110 via respective cam axles 145, 146. As illustrated, cams 151, 152 are secured to cam extensions 143, 144 so they may rotate but do not translate with respect to the stock assembly 110. This feature causes the distance from cam axle 145 to cam axle 146 to be fixed, even as the crossbow is drawn.

The width of the cams 151, 152 is less than the width spanned by limbs 121, 122. The limbs form an inner limb area within the span of the limbs in which the cams reside. In the example illustrated, the limbs are positioned so the forwardmost point of the limbs extend forward of the forwardmost points of the cams.

Each cam 151, 152 has two tracks. In this embodiment, the first is a circular track that runs along the outside circumference of cams 151, 152. The second track can be a circular or eccentric cam track 157 or 158 located on the underside of a respective cam 151, 152 (as seen in FIG. 3). The term circular refers to the cam track having a constant radius. The circular cam tracks can be partial and do not have to span 360 degrees.

In the embodiment shown, cams 151, 152 are circular in shape and are each attached via a central axle 145, 146. In other embodiments, eccentrically mounted cams may be used. Also, in other embodiments, the cams may not necessarily be circular, but may be any shape that allows the cam to rotate around the axle.

Figure 4:
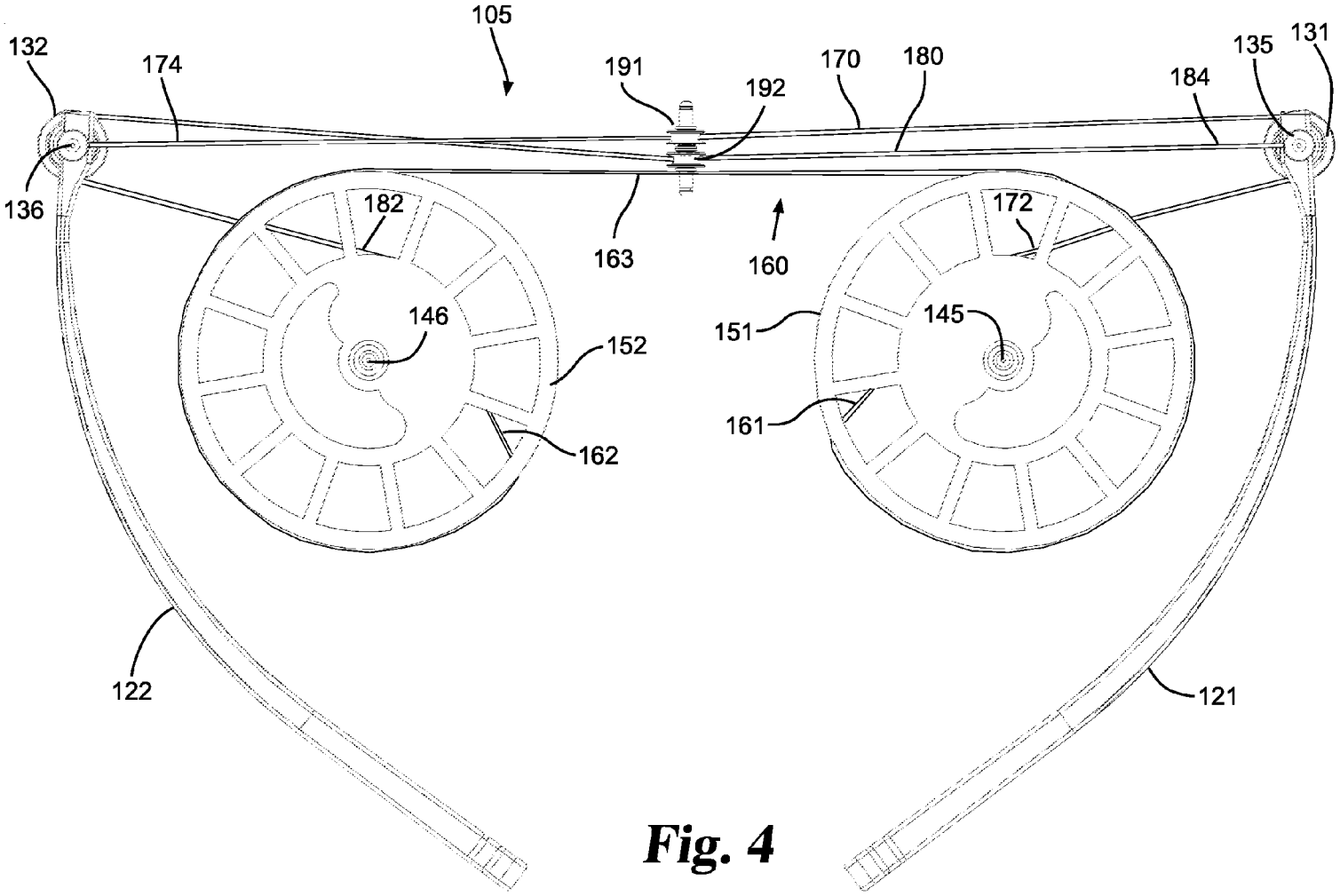
FIG. 4 is a top view of the crossbow system of FIG. 1 with the stock assembly removed.
Figure 5:
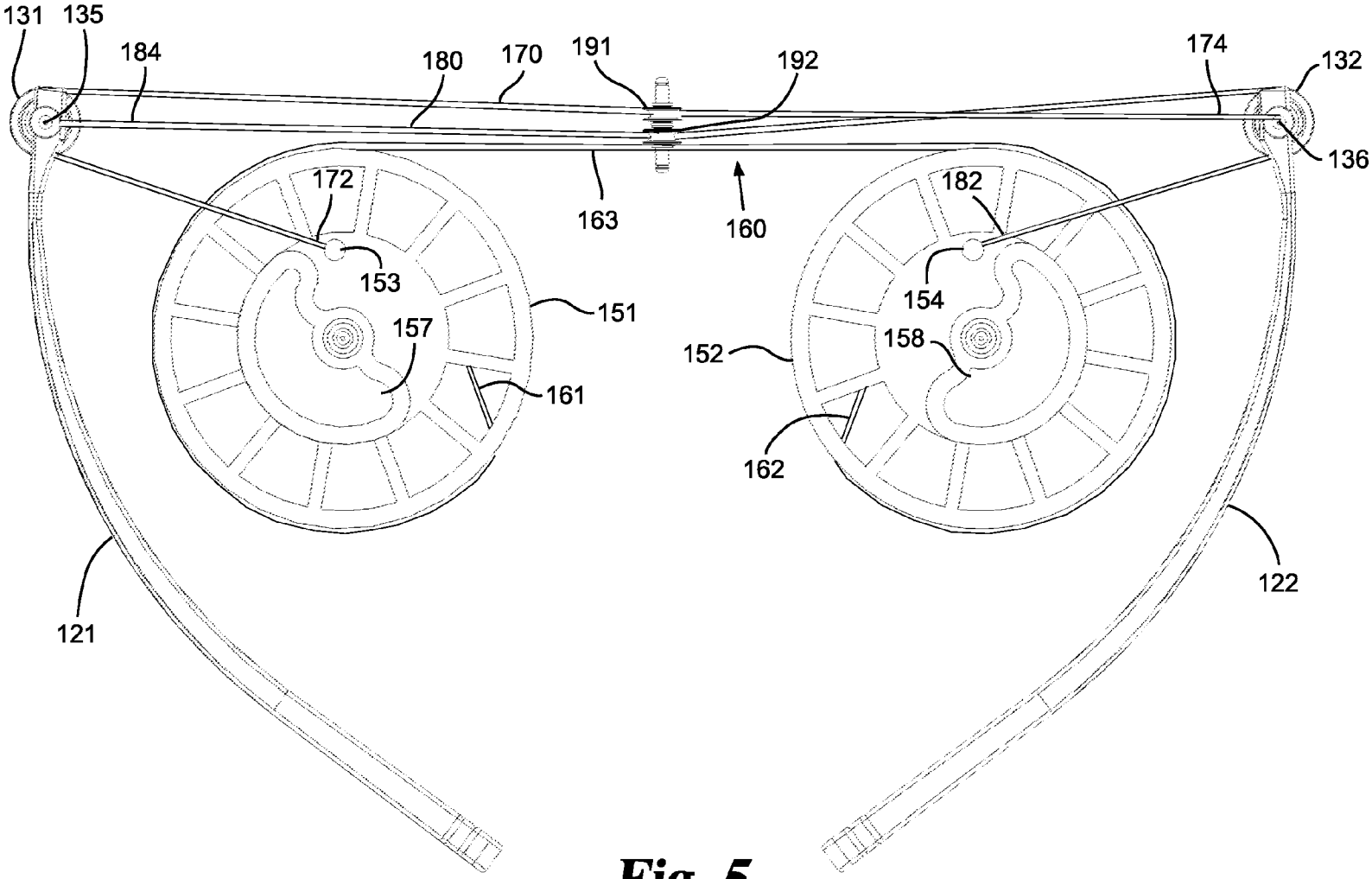
FIG. 5 is a bottom view of the crossbow system of FIG. 1 with the stock assembly removed.

A cable arrangement, in the embodiment shown, includes a bowstring 160. As seen in FIG. 4 and FIG. 5, bowstring 160 has a right end 161 and a left end 162 which are attached to respective anchor points on cams 151, 152. Bowstring 160 has a central medial portion 163, with end lengths wrapped around the circular, noneccentric track of each of the cams 151, 152 when the crossbow is in an undrawn position. As illustrated, the medial portion 163 is on the forward side of cams 151, 152.

Crossbow 100 also includes two power cables 170, 180. Power cable 170 has a cam end 172 and a fixed end 174. The cam end 172 is attached to anchor point 153 located on the bottom side of cam 151. Power cable 170 then wraps around pulley 131 and extends across the crossbow 100, underneath rail 114, to an attachment point adjacent the opposing limb tip, for example at axle 136. Similarly, power cable 180 has a cam end 182 and a fixed end 184. It is arranged in a manner symmetrical to the arrangement of power cable 170. Power cable 180 is attached to anchor point 154 located on the bottom side of cam 152. Power cable 180 then wraps around pulley 132 and extends across the bow, underneath rail 114, to an attachment point adjacent the opposing limb tip, for example axle 135. As illustrated, because the pulleys 131, 132 are positioned forward of the cams 151, 152, the portion of the power cables 170, 180 that span the pulleys are forward of the bowstring 160.

Optional cable guide pulleys 191, 192 are mounted to the underside of the rail 114 near the forward end of crossbow 100. When crossing under rail 114, power cable 170 passes through guide pulley 191 and power cable 180 passes through guide pulley 192.

When the crossbow is drawn by pulling the center 163 of bowstring 160 rearward, cams 151, 152 of FIG. 2 rotate counterclockwise and clockwise, respectively, so that bowstring 160 is fed out from the cams down the center of the crossbow 100 over the stock assembly 110. The bowstring is pulled between cam supports 147, 148. Meanwhile, the rotation of cams 151, 152 causes power cables 170, 180 to wrap around and into cam tracks 157, 158 respectively. This causes limbs 121, 122 to bend and store energy. The power cables 170, 180 and cam tracks 157, 158 are synchronized to balance the loads on respective limbs 121, 122.

Once fully drawn, bowstring 160 is secured at launch nock point 117 near the trigger mechanism 112. The launch nock point holds the bowstring 160 until the crossbow is ready to be fired. A bolt is inserted into groove 116, and the end of the bolt is positioned on the bowstring 160 at a nocking point. Once the bolt is situated in groove 116 and positioned on the nocking point 117, the crossbow 100 is ready to be fired upon operation of trigger mechanism 112.

Figure 6:
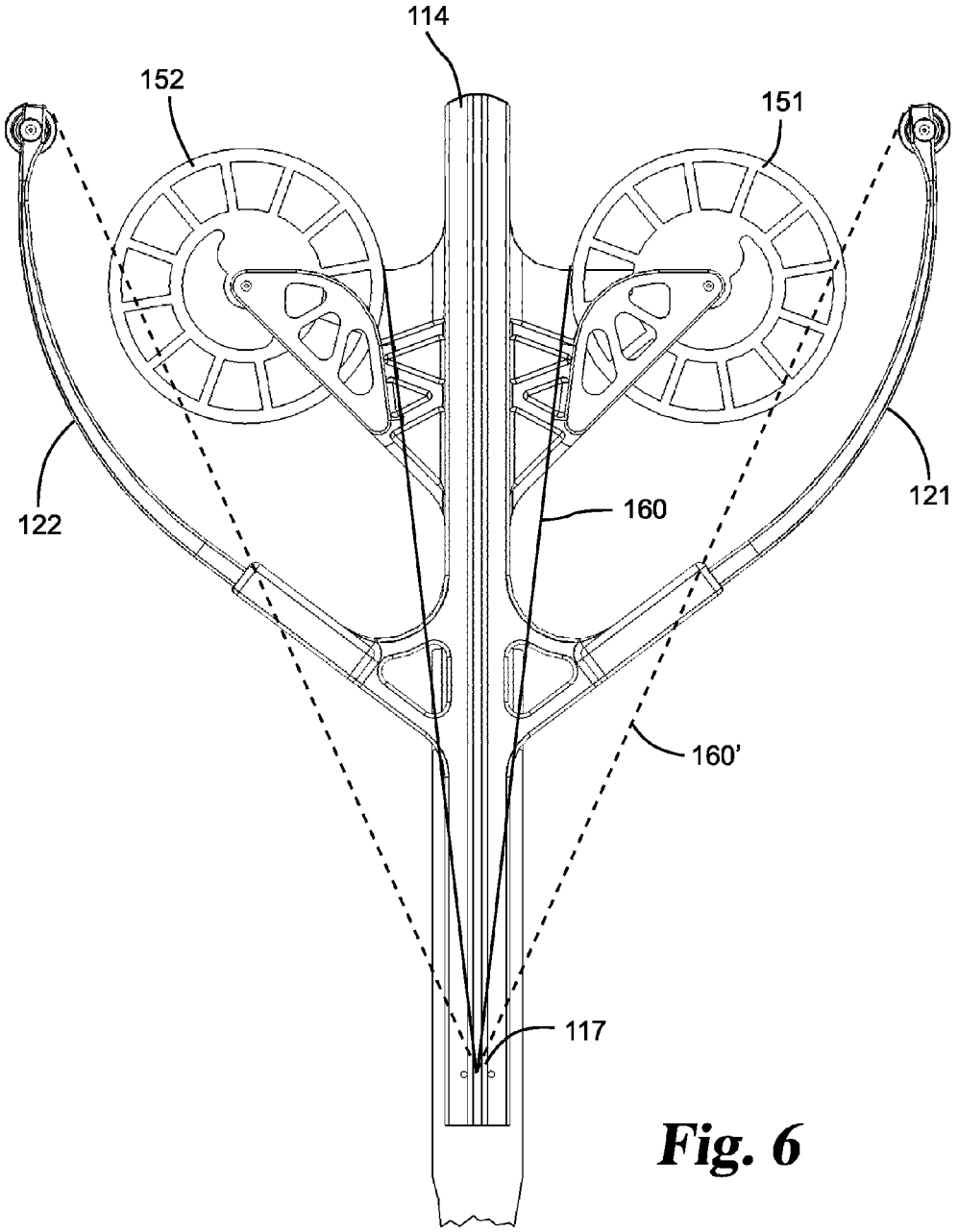
FIG. 6 is a top view of a portion of a crossbow system in a drawn position for an embodiment of the present disclosure.

FIG. 6 shows a comparison between the shape of bowstring 160 at full draw for an embodiment where cams 151, 152 are attached to rail 114 and a representative shape of a bowstring 160' as it would be in a traditional crossbow with the bowstring extended from the tips of limbs 121, 122. The narrower distance between the cams 151, 152 when they are attached to rail 114 creates a deeper or narrower "V" shape when the bowstring 160 is fully drawn, compared to the shape of bowstring 160' if the bowstring extended from points on limbs 121, 122.

Figure 7:
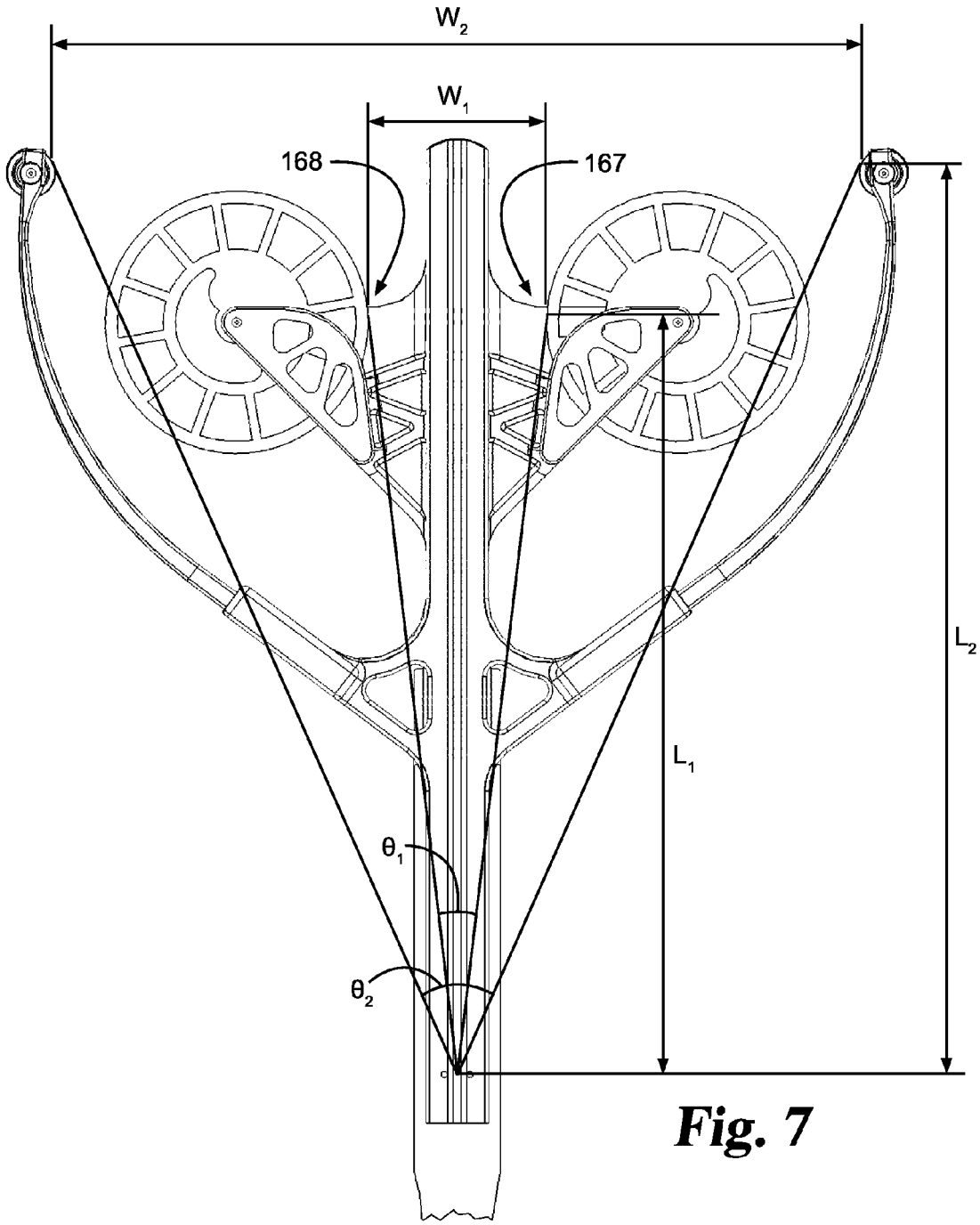
FIG. 7 is a diagram showing dimensions for a drawn bowstring for an embodiment of the present disclosure.

As shown in FIG. 7, there is a distance from launch nock point 117 to a disengagement point 167, 168 of the bowstring 160 and either cam 151 or 152. Disengagements points 167, 168 are located at the point where bowstring 160 is tangent to cams 151, 152. The distance from nock point 117 to disengagement points 167, 168 has a lateral component and a forward component. The forward component is designated in FIG. 7 by $L_1$. The lateral distance between the disengagement points 167, 168 is designated by $W_1$. The ratio between distance $L_1$ and $W_1$ in the embodiment shown is approximately 4:1. It is preferred that the ratio $L_1$:$W_1$ have a value greater than at least 3. For comparison, FIG. 7 also shows the dimensions $L_2$ and $W_2$, measured as if the bowstring were extended from points on limbs 121, 122. The ratio $L_2$:$W_2$ for the embodiment shown is approximately 1.1:1.

Also shown in FIG. 7, the interior angle formed by the V of the drawn bowstring between the disengagement points 167, 168 is designated as angle $\theta_1$ which can be compared to angle $\theta_2$ formed if the bowstring were extended from points on limbs 121, 122. In the embodiment illustrated, angle $\theta_2$ is approximately equal to 50°. The value of $\theta_1$ is relatively narrow. It may change in various embodiments, yet preferably angle $\theta_1$ is significantly less than angle $\theta_2$. For example, angle $\theta_1$ may be in a range between zero and 45°, and in some embodiments may be between zero and 25°. In the embodiment shown, angle $\theta_1$ is approximately equal to 15°.

Figure 8:
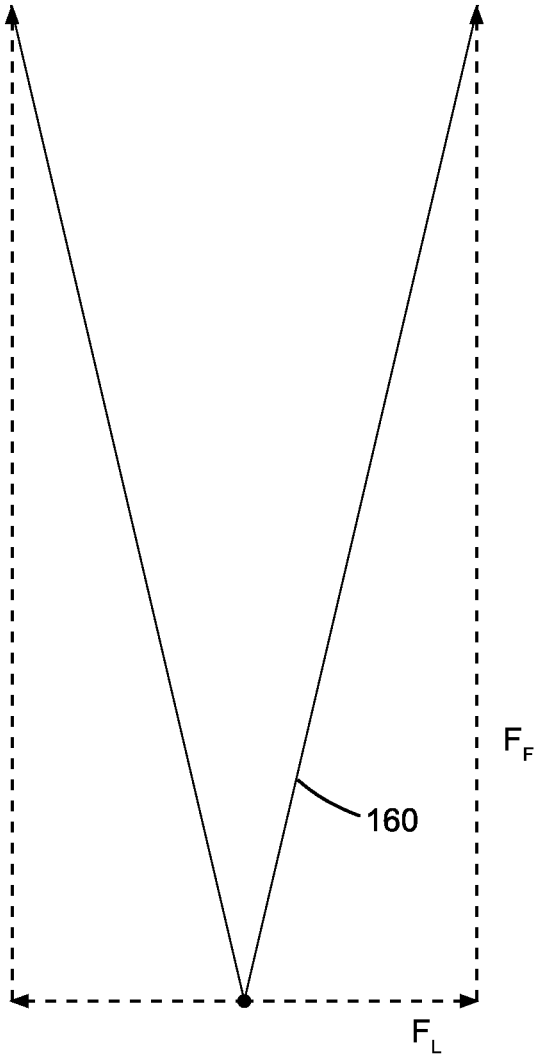
FIG. 8 is a force vector diagram for a drawn bowstring of a crossbow system for an embodiment of the present disclosure.

Looking at a force vector diagram, as shown in FIG. 8, the "V" of bowstring 160 generates a force in the forward direction, $F_F$, in a direction opposite the force used to draw the bowstring. This is the force that is directed forward into the bolt when the crossbow is fired. The force vector diagram also shows a force in the lateral direction, $F_L$. As the fully drawn V shape becomes narrower, the ratio of force in the forward direction $F_F$ to force in the lateral direction $F_L$ increases. As the crossbow is fired, angle $\theta_1$ is constantly changing until $F_F$ reaches zero.

The result of narrowing the V shape of the drawn bowstring is a more efficient crossbow because less force is lost in the lateral direction when the bowstring is released. By maintaining a narrow distance between cams 151, 152, more of the force is kept in the forward direction throughout the shot. This creates several advantages over a conventional crossbow that has the bowstring attached to a point near the limbs. For example, a crossbow can have an applied force $F_F$ equivalent to that of a conventional crossbow, yet it can be made with a lighter force applied to the limbs than a conventional crossbow due to improved efficiency and less force lost in the lateral direction. Another option is to make a crossbow that has similar force applied to the limbs as a conventional crossbow yet with a higher effective applied forward force $F_F$. This results in increased bolt speed due to efficiency.

The forward force imparted to the bolt is also increased by positioning bowstring 160 forward of the cam axles 145, 146 rather than rearward of the axles. This configuration increases the draw length or power stroke of the crossbow 100 without increasing the length of the rail or the stock. Larger draw length increases the amount of force applied to the bolt, which will increase its speed when fired.

The position of the cams 151, 152 attached to the rail stock assembly 110 instead of the limbs 121, 122 reduces the amount of mass and weight that is placed on the limbs. Less mass on the limbs allows greater acceleration and less vibration for a given draw force, which leads to increased bolt velocity.

In the embodiment shown, portions of the stock assembly 110 near butt end 111 have been removed to reduce the weight of the crossbow. Other embodiments may have different amounts of material removed from the stock assembly 110 in different patterns or may have no material removed from the stock assembly 110. In other embodiments, cam extensions 143, 144 may be "skeletonized", or have material from their interiors removed to further decrease the total weight of the crossbow.

Other embodiments of crossbow system 100 may have additional accessories attached to stock assembly 110 or other portions of the crossbow. For example, some embodiments may include any or all of the following: a scope, a dry-fire prevention mechanism, a safety, a cocking mechanism, or a foot stirrup.

Figure 9:
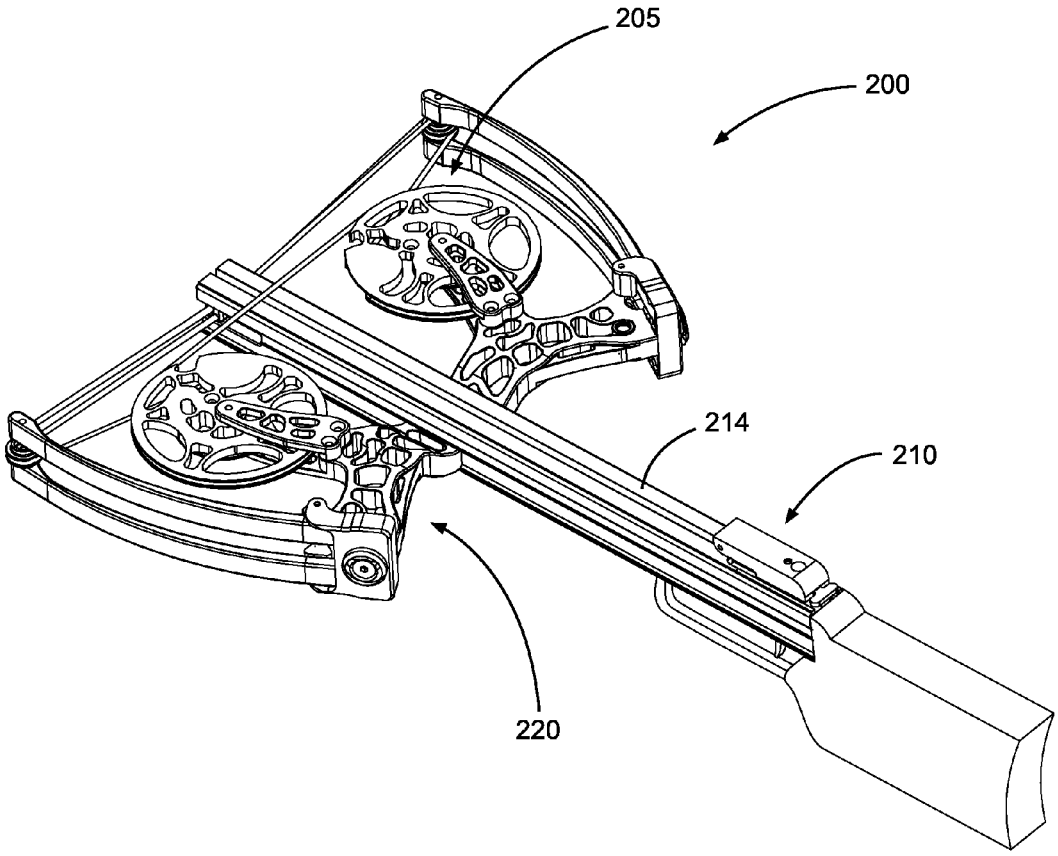
FIG. 9 is a perspective view of a crossbow system in an undrawn position for an embodiment of the present disclosure.
Figure 10:
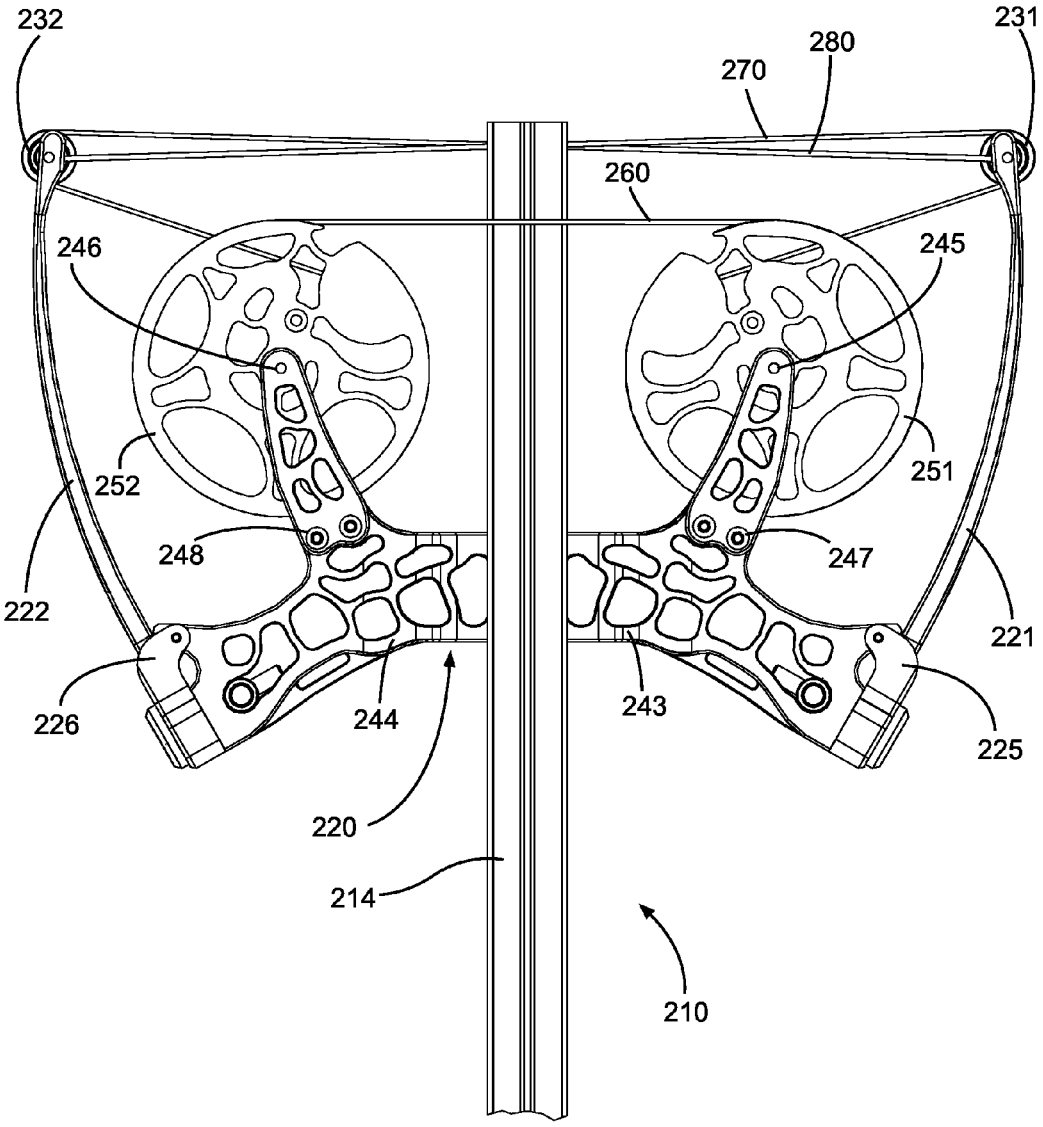
FIG. 10 is a top view of the crossbow system of FIG. 9.

An alternate embodiment of a crossbow system 200 is shown in FIGS. 9-10. Crossbow system 200 includes a crossbow cam system 205 and a stock assembly 210. Stock assembly 210 is similar to stock assembly 110 of the previous embodiment and includes a rail 214.

Stock assembly 210 includes a riser assembly 220 that extends to each side of rail 214. In some embodiments, riser extensions 243, 244 are mounted so they extend laterally from the sides of rail 214. Limbs 221, 222 attach to a respective riser extension 243, 244 at a limb pocket 225, 226 that is attached to the lateral end of a respective riser extension 243, 244. Each limb pocket 225, 226 receives one of limbs 221, 222. In the embodiment shown, limbs 221, 222 extend laterally from stock assembly 210 and forward of limb pockets 225, 226. An idler pulley 231, 232 is attached near the end of each limb 221, 222.

Cams 251, 252 are mounted to stock assembly 210 via the riser assembly 220, for example via riser extensions 243, 244. A cam support 247 is attached to riser extension 243 and a corresponding cam support 248 is attached to cam extension 244. A cam axle 245, 246 is connected to each cam support 247, 248. Cam axles 245, 246 each rotatably connect a respective cam 251, 252 to stock assembly 210 so that cams 251, 252 may rotate but cannot translate with respect to stock assembly 210. The distance from cam axle 245 to cam axle 246 does not change as crossbow 200 is drawn. Similar to crossbow system 100, limbs 221, 222 are positioned so the forwardmost point of the limbs extend forward of the forwardmost point of cams 251, 252.

A bowstring 260 extends between cams 251, 252 and can be positioned forward of cams 251, 252 when crossbow 200 is undrawn. Crossbow 200 also includes power cables 270, 280. As an example, power cable 270 is attached to an anchor point on cam 251 and then wrapped around idler pulley 231. Power cable 270 then extends across the crossbow 200 to an attachment point adjacent the tip of limb 222. Power cable 280 is arranged in a manner symmetrical to the arrangement of power cable 270.

Crossbow systems 100 and 200 may be made from any material that allows for effective operation of the crossbow. The material for different pieces of the crossbow system 100 may vary within the same embodiment. For example, in some embodiments, pieces of the crossbow system 100 may be made using metal, such as aluminum or steel, composites like carbon fiber or any of a variety of plastics, and also from wood.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A crossbow assembly comprising:

a stock assembly;

first and second cams rotatably mounted in respective fixed positions on said stock assembly;

a bowstring extending between said first and second cams, said bowstring having two ends and a central medial portion extending directly from said first cam to said second cam and having end lengths wrapped around a track of each of said first and second cams, wherein one of said bowstring ends is anchored to said first cam and the other of said bowstring ends is anchored to said second cam;

a pair of flexible limbs extending laterally from said stock assembly to limb tips; and, first and second pulleys, wherein one of said pulleys is mounted adjacent the tip of each of said flexible limbs.

2. The crossbow assembly of claim 1, wherein said central medial portion of said bowstring is positioned forward of said first and second cams when said bowstring is undrawn.

3. The crossbow assembly of claim 1, wherein said first and second pulleys each have pulley axles which are positioned forward of axles of said first and second cams.

4. The crossbow assembly of claim 1, wherein said flexible limbs extend laterally to define an inner limb area and the entirety of said first and second cams are located within said inner limb area.

5. The crossbow assembly of claim 1, wherein when said central medial portion of said bowstring is drawn and held in a nock point, said central medial portion of said bowstring forms first and second disengagement points with said respective first and second cams, wherein the distance from said nock point to said first disengagement point and said second disengagement point has a forward component distance and the disengagement points are separated by a lateral distance; and, wherein the ratio between said forward component distance and said lateral distance between said first and second disengagement points is greater than 3.

6. The crossbow assembly of claim 5, comprising an interior angle defined by said central medial portion of said bowstring between said first and second disengagement points with a vertex at a nock point when said bowstring is drawn, and wherein said angle is less than approximately 25 degrees.

7. The crossbow assembly of claim 1, wherein said first and second cams each include a first circular track and a second circular partial track.

8. The crossbow assembly of claim 1, comprising a pair of limb extensions on said stock assembly, wherein said flexible limbs are each attached to said stock assembly at a respective limb extension, and wherein said limbs extend forward from said limb extensions to said first and second pulleys.

9. The crossbow assembly of claim 1, further comprising a first power cable including two ends, wherein one end of said first power cable is attached to an anchor point on said first cam, said first power cable having a medial portion which wraps around a portion of said first pulley and wherein said first power cable then extends across the crossbow assembly with the other end of said first power cable connected to an attachment point on the limb on which said second pulley is mounted; and, a second power cable including two ends, wherein one end of said second power cable is attached to an anchor point on said second cam, said second power cable having a medial portion which wraps around a portion of said second pulley and wherein said second power cable then extends across the crossbow assembly with the other end of said second power cable connected to an attachment point on the limb on which said first pulley is mounted.

10. A crossbow assembly comprising:

a stock assembly;

first and second cams rotatably mounted via axles to respective fixed locations on said stock assembly;

a bowstring extending between said first and second cams, said bowstring having two ends and a central medial portion extending directly from said first cam to said second cam and having end lengths wrapped around a track of each of said first and second cams, wherein one of said bowstring ends is anchored to said first cam and the other of said bowstring ends is anchored to said second cam;

a pair of flexible limbs extending laterally from said stock assembly to limb tips;

first and second pulleys, wherein one of said pulleys is mounted adjacent the tip of each of said flexible limbs; and, wherein the axle-to-axle distance between said first cam and said second cam remains fixed as the bowstring is drawn.

11. The crossbow assembly of claim 10, wherein said central medial portion of said bowstring is positioned forward of said first and second cams when said bowstring is undrawn.

12. The crossbow assembly of claim 10, wherein said first and second pulleys each have pulley axles which are positioned forward of axles of said first and second cams.

13. The crossbow assembly of claim 10, wherein said stock assembly includes cam supports and said each of said axles is located on a respective cam support.

14. The crossbow assembly of claim 10, wherein when said central medial portion of said bowstring is drawn and held in a nock point, said central medial portion of said bowstring defines first and second disengagement points with said respective first and second cams, wherein the distance from said nock point to said first disengagement point and said second disengagement point has a forward component distance and the disengagement points are separated by a lateral distance; and, wherein the ratio between said forward component distance and said lateral distance between said first and second disengagement points is greater than 3.

15. The crossbow assembly of claim 14, comprising an interior angle defined by said central medial portion of said bowstring between said first and second disengagement points with a vertex at a nock point when said bowstring is drawn, and wherein said angle is less than approximately 25 degrees.

16. The crossbow assembly of claim 10, wherein said first and second cams each include a first circular track and a second circular track.

17. The crossbow assembly of claim 10, further comprising a first power cable including two ends, wherein one end of said first power cable is attached to an anchor point on said first cam, said first power cable having a medial portion which wraps around a portion of said first pulley and wherein said first power cable then extends across the crossbow assembly with the other end of said first power cable connected to an attachment point on the limb on which said second pulley is mounted; and, a second power cable including two ends, wherein one end of said second power cable is attached to an anchor point on said second cam, said second power cable having a medial portion which wraps around a portion of said second pulley and wherein said second power cable then extends across the crossbow assembly with the other end of said second power cable connected to an attachment point on the limb on which said first pulley is mounted.

18. A crossbow assembly comprising:

a stock assembly;

first and second cams rotatably mounted via axles to respective fixed points on said stock assembly;

a bowstring extending between said first and second cams, said bowstring having two ends and a central medial portion extending directly from said first cam to said second cam and having end lengths wrapped around a track of each of said first and second cams, wherein one of said bowstring ends is anchored to said first cam and the other of said bowstring ends is anchored to said second cam;

wherein said medial portion of said bowstring is positioned forward of said first and second cams when said bowstring is undrawn;

wherein the axle-to-axle distance between said first cam and said second cam remains fixed as the bowstring is drawn; and, a pair of flexible limbs extending laterally from said stock assembly wherein said flexible limbs define an inner limb area and the entirety of said first and second cams are located within said inner limb area.

19. The crossbow assembly of claim 18, wherein when said bowstring is drawn and held in a nock point, said bowstring defines first and second disengagement points with said respective first and second cams, wherein the distance from said nock point to said first disengagement point and said second disengagement point has a forward component distance and the disengagement points are separated by a lateral distance; and, wherein the ratio between said forward component distance and said lateral distance between said first and second disengagement points is greater than 3.

20. The crossbow assembly of claim 19, comprising an interior angle defined by said bowstring between said first and second disengagement points with a vertex at a nock point when said bowstring is drawn, and wherein said angle is less than approximately 25 degrees.

* * * * *